US005868595A

United States Patent [19]

Lopes

[11] Patent Number: 5,868,595

[45] **Date of Patent: *Feb. 9, 1999**

[54] WATER SKI

[76] Inventor: Timothy Michael Lopes, 821 Lisa La., Porterville, Calif. 93257

[ * ] Notice: The terminal 63 months of this patent has been disclaimed.

[21] Appl. No.: 585,921

[22] Filed: Sep. 21, 1990

[51] Int. Cl.[6] ..... B63B 35/81

[52] U.S. Cl. ..... 441/79

[58] Field of Search ..... 441/68, 79, 70; 114/127, 132, 138, 140, 141

[56] References Cited

U.S. PATENT DOCUMENTS

| | | | |
|---|---|---|---|
| 3,119,130 | 1/1964 | Senne et al. | 441/70 |
| 3,774,254 | 11/1973 | Meyer | 441/68 |
| 4,649,847 | 3/1987 | Tinkler et al. | 441/68 X |

*Primary Examiner*—Sherman D. Basinger
*Attorney, Agent, or Firm*—Dennis B. Haase

[57] ABSTRACT

A water ski having a fin mounted to an inflexible carrier and protruding through a rear portion of the ski in order that the user may take advantage of the natural flexibility of the ski to vary the depth of the fin in the water during use.

11 Claims, 1 Drawing Sheet

WATER SKI

The present invention relates to improvements in water skis, and has particular, although not exclusive benefit in slalom skiing, where frequent sharp turns are required.

BACKGROUND OF THE INVENTION

The present invention pertains to an improved water ski which enhances the ability of the user to control the ski during maneuvers.

Present technology provides a ski which includes a vertically depending fin at the rear of the ski, and horizontal stabilizers, sometimes referred to as "spoilers", on the fin. Certain specialty skis manufactured by Kidder International, for example, include means for manual adjustment of the horizontal stabilizers through an approximate 10° angle. Conventional wisdom dictates, however, that a skier will not stop in the middle of the race to adjust his horizontal stabilizer, any more than he could expect to reach back to adjust the height of his fin as suggested in Meyer U.S. Pat. No. 3,087,173, or Durfey U.S. Pat. No. 3,066,327. The reality is that a skier, particularly a skier engaged in competition such as slalom racing, has a distinct advantage over the competition if he is able to adjust the depth of his fin and the angle of the horizontal stabilizers while in motion, and without need to contort the body or stray from one's concentration in order to reach for some lever or other device to make the necessary adjustment.

Accordingly, it is an objective of the present invention to provide a novel ski which allows the user to automatically adjust fin height and horizontal stabilizer angle while skiing.

Another, and related objective of the present invention, is to provide a ski which permits the user to quickly and automatically adjust to changing conditions by raising or lowering the ski's fin, without resort to moving parts, while at the same time adjusting the angle of the horizontal stabilizer.

BRIEF DESCRIPTION OF THE DRAWINGS

Having provided an overview of the environment in which the present invention finds great use, the invention is more fully explained by reference to the drawings, in which.

DESCRIPTION OF THE PREFERRED EMBODIMENT

Figures 1, 2, 3, 4, 5:
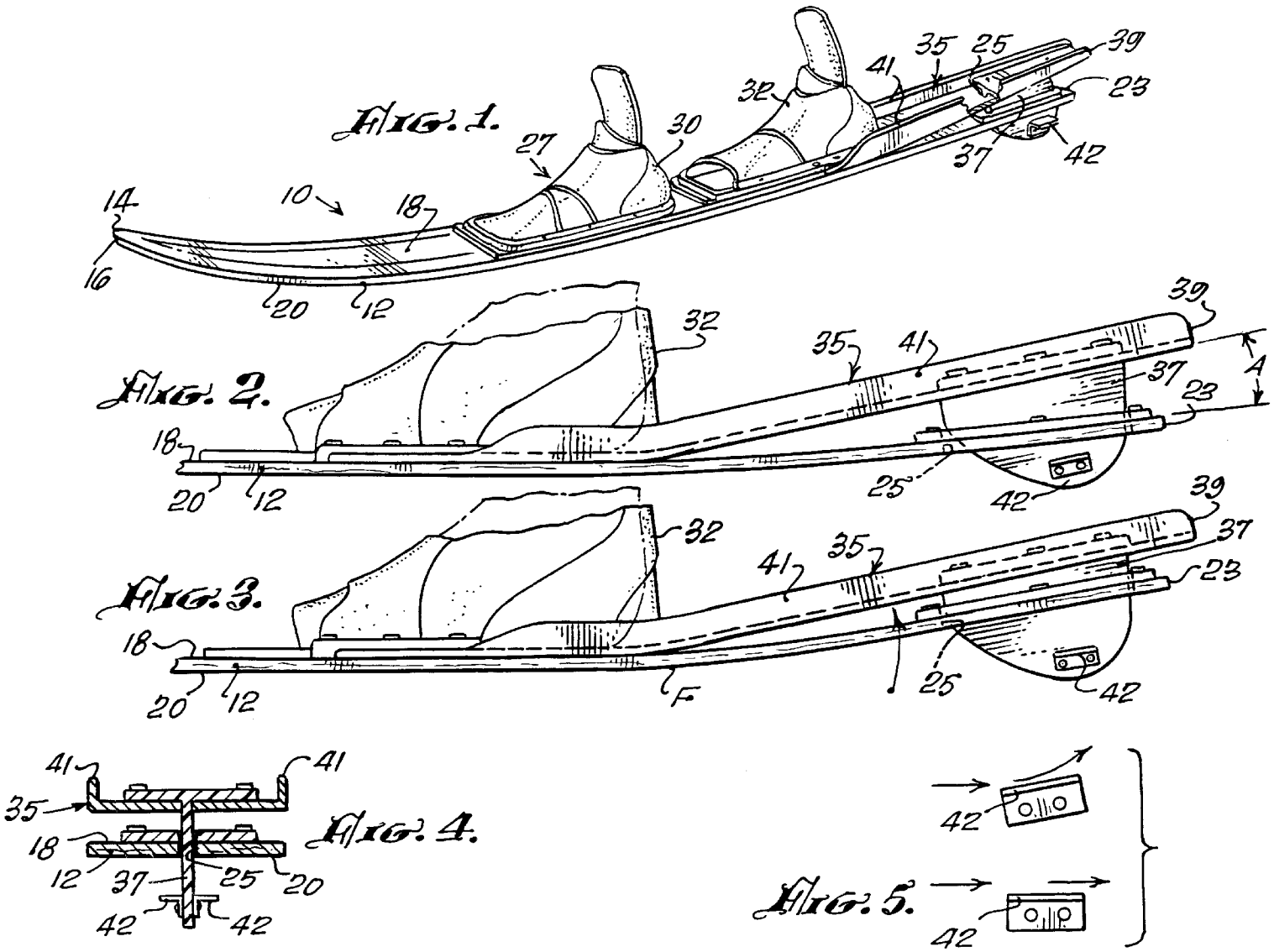
FIG. 1 is a pictorial view of a ski constructed in accordance with the present invention.
FIG. 2 is a side elevation of the rear portion of the ski of FIG. 1, illustrating the relative position of the fin holder and fin relative to the ski.
FIG. 3 is a view similar to that of FIG. 2, illustrating the relationship between the fin holder and the ski upon application of pressure to the ski, causing it to flex.
FIG. 4 is a cross sectional view of the ski of the present invention, taken along line 4—4 of FIG. 3.
FIG. 5 illustrates the stabilizer of the present inventor in two extremes of its possible position.

With reference now to the drawings, and in particular, FIG. 1, a water ski 10 is illustrated in considerable detail.

The water ski comprises a conventional ski member 12, constructed in accordance with the latest technology. The ski member is provided with a tapered nose 14, having a leading edge 16 designed to cut through the water with a minimum of friction. An upper surface 18 is provided in conjunction with lower surface 20, the latter being the surface which rides on the water to support the user.

In order to accommodate a fin, the rear end 23, in accordance with the invention, is slotted at 25. The slot 25 is equi-distant from the sides of the ski and extends from a point just inboard of the end 23 longitudinally towards the nose 14.

Any number of combinations and permutations of user support devices, or binders, are available, and do not enhance or detract from the novelty of the present invention. Illustrated in the drawings, is a well known boot 27 which fully encases the foot of the user. In the present instance, where is provided a forward or front boot 30, with a rear boot 32 mounted by any suitable means immediately to the rear of the heel of the boot 30. While it is desirable, in a racing environment, to have the feet as close together as possible, it will be appreciated that the boots may be spaced from one another without departure from the invention. Likewise, there are several binders, including heel cuffs and arch straps available as an alternative to the boots shown, and the illustration of boots is intended to be nothing more than a depiction of equipment that is best suited for slalom racing.

With a particular reference now to FIG. 2, and in order to accomplish the objectives of the present invention, there is provided a fin carrier 35, which is affixed to the upper surface 18 of the ski member 12 by means of screws or other suitable fastening devices. The fin carrier is constructed of relatively inflexible material, and extends rearwardly from its point of attachment, which may be either beneath the forward boot 30 or the rear boot 32 at an acute angle "A" relative to the upper surface 18 of the ski member 12. While the angle A may vary, depending upon usage, it has been found that an angle formed by a space between the fin carrier 35 and the ski member 12 of between 1½ inches to 3 inches provides the most efficient result.

A vertical fin 37 is mounted longitudinally at a point inboard of the rear end 39 of the fin carrier, and depends downwardly and through the slot 25 at the rear of the ski member 12. Ridges or flanges 41 formed about the edges add rigidity to the carrier 37.

In order to enhance control of the ski, essentially horizontal stabilizers 42 are located on either side of the fin, and as seen in FIG. 4, extend outwardly, and in the skis relaxed position, angle slightly downwardly relative to the bottom surface 20 of the ski member 12. FIG. 5 illustrates the horizontal stabilizer in its two extensions of position. The upper illustration shows the position assumed by the stabilizer in FIG. 3, or unflexed position. It will be readily seen that water impinges on the top of the stabilizer blade 42 causing a downward force. In the flexed position, however, the blade is parallel to water flow, and drag and down forces are eliminated, permitting greater acceleration through turns.

While it has been previously pointed out that the present invention has great utility in slalom racing, although not exclusively so, it is an important feature of the present invention that the ski complies with all of the rules and regulations of the World Water Ski Federation and the American Water Ski Association, the governing bodies which promulgate and enforce the rules pertaining to water ski slalom racing. One such rule is that the ski may have no moving parts, and the unique construction previously described, meets that criteria in every respect. A brief description of the uses of the ski will emphasize the point.

It will be understood that virtually all water skis, particularly of the high tech variety, are flexible, i.e., as the user shifts his weight, the ski will bend. While the flex point may vary, its existence is necessary, and universal. In normal use, the ski assumes the attitude depicted in FIG. 2, and as seen in FIG. 5, down forces on the horizontal stabilizer hold the ski in the water. In slalom, as well as in high speed recreational skiing, the user often finds it necessary and desirable to be able to make sharp turns, often over the wake of the boat pulling the skier. Depending upon the amount of pull being experienced by the skier, he or she is able to achieve very sharp angles relative to the water, and, as a consequence, without proper controls, the ski may be forced out of its directional path and literally slip out from beneath the user. Not only is such a result dangerous, but the natural and probable consequence is the loss of the contest.

The structure of the present invention brings the skier an unparalleled level of control under extreme conditions without departure from the rules. Thus, it will be seen that when the skier goes into a turn, by shifting his weight towards the rear of the ski, the ski member 12 is flexed at a point F causing the rear portion to bend upwardly. Such upward bending automatically results in a greater depth of the fin 37 in the water. Accordingly, application of foot pressure on the fin carrier permits the skier to vary the depth of the fin in the water and change the stabilizer angle to increase or decrease ski drag. The same movement also changes the angle of the horizontal stabilizers 42, seen best in FIG. 5, to a neutral angle relative to the line of travel. As a result, the ski experiences minimum drag thereby permitting maximum acceleration which inhibits loss of vertical and horizontal stability, and, of course, enhancing control by the skier on turns and through the wake created by the pulling boat.

It will be appreciated that within the limits defined by the angle A between the fin carrier and the ski member 12, the user may vary the depth of the fin and the angle of the horizontal stabilizers at will, automatically, and to the precise amount needed to control of the ski during the maneuver being performed.

Having thus described a preferred embodiment of the present invention, what is claimed is:

1. In a water ski having:

an elongated ski member; said ski member being capable of flexion in response to application of pressure in use;

front and rear binders attached in longitudinal array to the upper surface of said ski member for receipt of the user's feet; the improvement comprising;

means defining a relatively inflexible fin carrier, said fin carrier being affixed to said upper surface of said ski member forward of the rear end of said ski member, and extending rearwardly at an acute angle with respect to said ski member;

a fin attached to, and depending from, the free end of said fin carrier;

means defining a slot in said ski member, said slot being aligned with said fin such that said fin protrudes through said slot and is freely reciprocal therethrough;

means defining a stabilizer mounted on either side of said fin on the portion thereof protruding beneath said ski member;

said stabilizer being disposed at a downward angle with respect to the bottom of the ski in its unflexed position; and whereby foot pressure on said fin carrier applied by the user results in flexing of said ski member to simultaneously vary the depth of said fin in the water, and variation of said stabilizer angle to increase or decrease ski drag.

2. The water ski of claim 1 wherein;

said fin carrier is affixed to said ski member forward of said rear binder.

3. The water ski of claim 1 wherein;

said fin carrier is affixed beneath said forward binding.

4. The water ski of claim 1 wherein:

an acute angle is formed between said ski member and said fin carrier such that the maximum space between the said fin carrier and said ski member ranges between 1½ inches and 3 inches.

5. The water ski of claim 2 wherein:

an acute angle is formed between said ski member and said fin carrier such that the maximum space between said fin carrier and said ski member, ranges between 1½ inches and 3 inches.

6. The water ski of claim 3 wherein:

an acute angle is formed between said ski member and said fin carrier such that the maximum space between said fin carrier and said ski member, ranges between 1½ inches and 3 inches.

7. The water ski of claim 1 wherein:

said fin carrier being formed along its opposite sides with an upwardly extending ridge.

8. In a water ski, having:

an elongated ski member; said ski member being capable of flexion in response to application of pressure in use;

front and rear binders attached in longitudinal array to the upper surface of said ski member for receipt of the user's feet; the improvement comprising;

means defining a relatively inflexible fin carrier, said fin carrier being affixed to said upper surface of said ski member forward of the rear end of said ski member, and extending rearwardly at an acute angle with respect to said ski member;

a fin attached to, and depending from, the free end of said fin carrier;

means defining a slot in said ski member, said slot being aligned with said fin such that said fin protrudes through said slot and is freely reciprocal therethrough.

9. The water ski of claim 8 wherein:

said fin carrier is affixed to said ski member forward of said rear binder.

10. The water ski of claim 8 wherein:

said fin carrier is affixed beneath said forward binding.

11. The water ski of claim 8 wherein:

an acute angle is formed between said ski member and said fin carrier such that the maximum space between the said fin carrier and said ski member ranges between 1½ inches and 3 inches.

* * * * *